US005855486A

United States Patent [19]

Fukamachi et al.

[11] Patent Number: 5,855,486

[45] Date of Patent: Jan. 5, 1999

[54] DIVISIONAL CONNECTOR

[75] Inventors: Makoto Fukamachi; Satoru Nishide; Yuichi Nankoh, all of Yokkaichi, Japan

[73] Assignee: Sumitomo Wiring Systems, Ltd., Japan

[21] Appl. No.: 835,230

[22] Filed: Apr. 7, 1997

Related U.S. Application Data

[63] Continuation of Ser. No. 523,593, Sep. 5, 1995, abandoned.

[30] Foreign Application Priority Data

Sep. 6, 1994 [JP] Japan ..... 6-239488
Sep. 30, 1994 [JP] Japan ..... 6-262056

[51] Int. Cl.[6] ..... H01R 13/62

[52] U.S. Cl. ..... 439/157; 439/701

[58] Field of Search ..... 439/152–160, 439/540.1, 696, 701, 717

[56] References Cited

U.S. PATENT DOCUMENTS

| | | | |
|---|---|---|---|
| 5,312,268 | 5/1994 | Sumida | 439/701 |
| 5,326,279 | 7/1994 | Sumida | 439/157 |
| 5,454,733 | 10/1995 | Watanabe et al. | 439/540.1 |
| 5,474,462 | 12/1995 | Yamanashi | 439/157 |

FOREIGN PATENT DOCUMENTS

| | | |
|---|---|---|
| 0 315 924 A1 | 5/1989 | European Pat. Off. . |
| 549 371 A2 | 6/1993 | European Pat. Off. . |
| 4-94278 | 8/1992 | Japan . |
| 4-274180 | 9/1992 | Japan . |
| 4-129477 | 11/1992 | Japan . |
| 5-182716 | 7/1993 | Japan . |
| 5-94967 | 12/1993 | Japan . |
| 6-119955 | 4/1994 | Japan . |
| 2 274 559 | 7/1994 | United Kingdom . |

*Primary Examiner*—Gary F. Paumen
*Assistant Examiner*—Brian J. Biggi
*Attorney, Agent, or Firm*—Banner & Witcoff, Ltd.

[57] ABSTRACT

Male sub-connectors 3 are accommodated in apertures 2 formed in a male frame 1, and female sub-connectors 23 are accommodated in apertures 22 formed in a female frame 21. A guide wall 15, on the inside of which the female frame 21 fits closely, is provided around the entire periphery of the top surface of the male frame 1. The female frame 21 is temporarily assembled with hooks 56, which engage longitudinal grooves 57 in the guide wall 15. When a lever 40 is operated so as to draw the male and female frame together, the guide wall 15 ensures the connectors themselves are relieved of lateral loads. In an alternative embodiment a similar arrangement is provided between one pair of connectors tightly engaged in the respective frames.

13 Claims, 10 Drawing Sheets

DIVISIONAL CONNECTOR

This is a continuation of application Ser. No. 08/523,593, filed on Sept. 5, 1995, now abandoned.

TECHNICAL FIELD

The present invention relates to an improvement in a split electrical connector.

BACKGROUND OF THE INVENTION

Connectors of a split type are sometimes used in multi-electrode connectors of a type having for example up to several tens of terminals. Such connectors are useful in preventing erroneous insertion of the metal terminals in the connector body.

One example of such a split connector has male and female frames which are provided with male and female connectors split into a plurality of sub-connectors each having a small number of metal terminals. The frames have a plurality of accommodating apertures which house these split male and female sub-connectors separately. Each sub-connector is inserted into an accommodating aperture of the corresponding frame, its front surface coming up against an abutment wall formed on the inside surface of the respective aperture, and its rear surface being latched by a resilient latching piece projecting on the inside surface of the aperture so that it is retained in the frame. Furthermore, the arrangement is such that a lever formed with an arc-shaped cam groove is pivotally supported on one of the frames, a follower pin projecting from the other frame engaging this cam groove, such that by turning the lever, the one frame is drawn to the other frame and the corresponding male and female sub-connectors are fitted together and connected in a single action.

Such split connectors generally accommodate the sub-connectors in the frame apertures with a fixed clearance in order to accommodate mispositioning within tolerance between corresponding pairs of sub-connectors. Meanwhile, in units in which a lever is used to couple the two frames as described above, lateral loading acts on the frame which is being drawn in, acting in a direction at right angles to the direction of approach to the companion frame. As a result, when a clearance is provided as described above, the sub-connector which is being drawn in will engage with its companion sub-connector in a tilted or stressed state due to the lateral movement, and the electrical contact is liable to lack reliability since, inter alia, the male and female metal terminals with which the sub-connectors are equipped may meet only partially.

Furthermore, as regards the structure in the portion where the resilient latching pieces engage the rear surfaces of sub-connector when it is accommodated in an aperture, in the past the unit has generally had a pair of resilient latching pieces placed in the central area in the length direction of the two corresponding edges of the sub-connector. Consequently, if a sub-connector being drawn in is made to engage while a lateral load is acting as described above, it will tilt as the companion sub-connector inclines, pivoting about the latching portions, and there is a similar risk that the electrical contact between the male and female metal terminals will not be secure.

Moreover, in connectors with a lever arrangement the male and female frames are coupled by turning the lever which is made of a synthetic resin plate, and it is preferable that the two frames can be temporarily assembled prior to the operation of turning the lever so that the holding hand is free and the turning operation can be performed smoothly. In the prior art this temporary assembly has been achieved by inserting a follower pin, which is on the frame being drawn in, into the leading end of a cam groove formed in the lever while resiliently deforming the said lever. However, the lever itself is liable to warping after being manufactured and the follower pin is subject to gradual plastic deformation as it is repeatedly inserted and removed so that the follower pin is eventually no longer able to fit into the cam groove properly, which means that the temporary assembly of the frames is not stable.

The present invention has been arrived at based on the above situation, and it aims to make corresponding male and female sub-connectors engage with each other in a direct line. This ensures that the male and female metal terminals connect with each other properly.

SUMMARY OF THE INVENTION

According to the invention there is provided an electrical connector assembly comprising first and second connectors each comprising a frame having a plurality of through apertures, and each of said apertures being adapted to receive and retain one of a plurality of male and female sub-connectors having electrical terminals, a coupling device acting between the connectors and operable to draw the connectors together in use, and said male and female sub-connectors being arranged in aligned pairs so as to interconnect as said connectors are drawn together in use;

said connectors further including guide surfaces of the frame adapted to interengage and guide said connectors into mutual engagement such that said terminals are relieved of guiding forces.

The guide surfaces are fixed relative to the respective frames and thus prevent lateral movement in a direction perpendicular to the direction in which the terminals approach. In such an arrangement the forces which result in misalignment of the terminals are resisted by the guide surfaces, and accordingly the terminals themselves are subjected only to axial engagement forces. As a result the electrical connection is more reliable, and the terminals can be optimised for connection only.

In the preferred embodiment the first and second connectors have substantially planar meeting faces, and the guide surfaces extend perpendicular to said meeting faces.

Preferably the guide surfaces are integral with the frames and may comprise an upstanding peripheral wall of one frame. The peripheral wall defines a socket to receive a closely fitting surface of the other frame. Alternatively one pair of sub-connectors may be a tight fit in the respective frame, and the guide surfaces may be provided on this pair of sub-connectors. This latter arrangement in which the tightly fitted sub-connectors act as parts of the respective frames, ensures that other pairs of sub-connectors may be loosely fitted in the frames to accommodate production tolerances.

The assembly may further include a latch to releasably engage the guide surfaces at a separation of the terminals of the connectors. Such an arrangement ensures that the connectors are latched to one another so that they can be held in one hand whilst the other hand actuates the coupling device to draw the connectors together. The latch may be provided on the frames or on a relatively fixed pair of sub-connectors within the frames.

In a preferred embodiment the sub-connectors include proximal abutments for engagement with the frame on insertion therein, and said frames include resilient latching members for engagement with distal portions of the respective sub-connectors. Preferably the latching members engage the distal corners of the sub-connectors, thereby providing maximum resistance to tilting of the sub-connectors within their respective frame apertures.

BRIEF DESCRIPTION OF THE DRAWINGS

Other features of the invention will be apparent from the following description of several preferred embodiments, described with reference to the accompanying drawings in which.

DESCRIPTION OF THE PREFERRED EMBODIMENTS

The present invention is described below with reference to FIG. 1 to FIG. 8 which illustrate a first embodiment.

Figure 1:
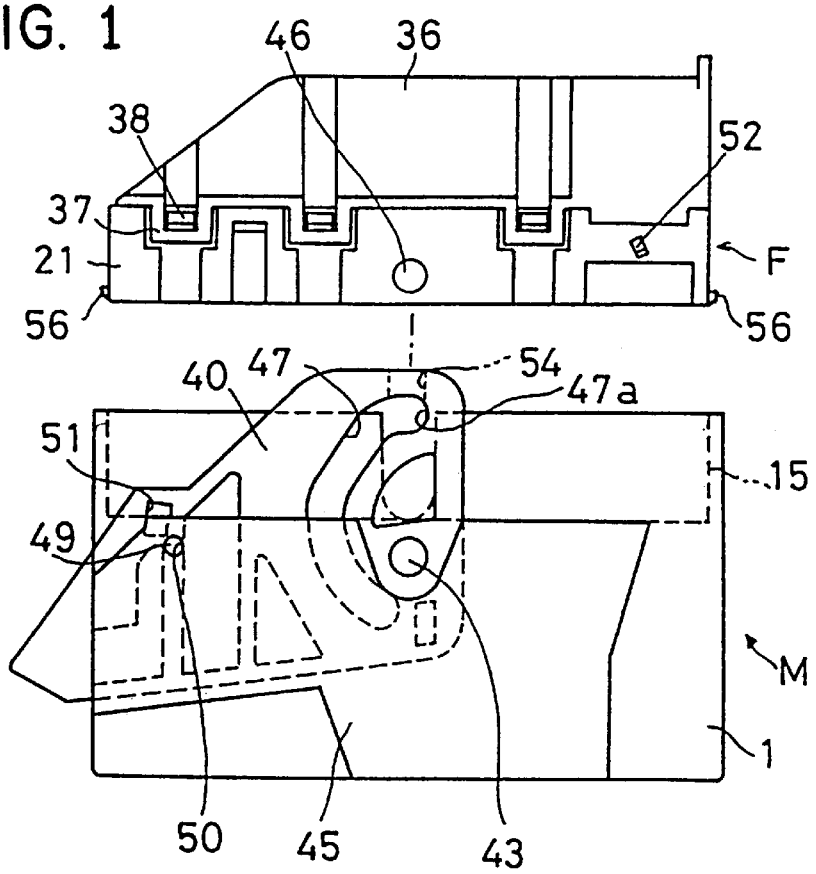
FIG. 1 is a front elevation of a split connector according to one embodiment of the present invention, and prior to assembly.

As shown in FIG. 1, the present embodiment has a male-side split connector M and a female-side split connector F which are coupled with each other in use.

Figure 2:
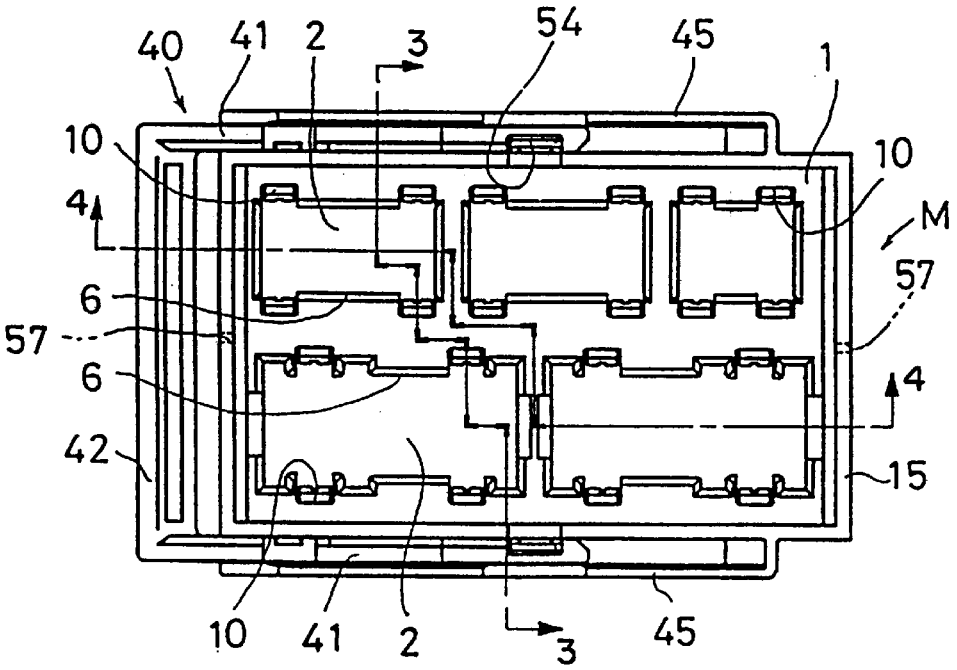
FIG. 2 is a plan view of the split connector on the male side.

The male-side split connector is described mainly with reference to FIG. 1 to FIG. 4 and has a male frame 1 which forms an approximate right-angled parallelepiped externally. As shown in FIG. 2, this male frame 1 has formed in it at both sides a plurality of through apertures 2, each forming an approximate rectangle in plan. In the present embodiment, five apertures are provided, two on one side and three on the other side. Male sub-connectors 3 equipped with metal male terminals are accommodated individually in each aperture 2. It should be noted that, although the shapes of the apertures 2 and the male sub-connectors 3 differ, the basic shape and function are the same and therefore in this description the same reference has been given to all the apertures 2, male sub-connectors 3 and ancillary members for accommodating the male sub-connectors 3.

Figure 3:
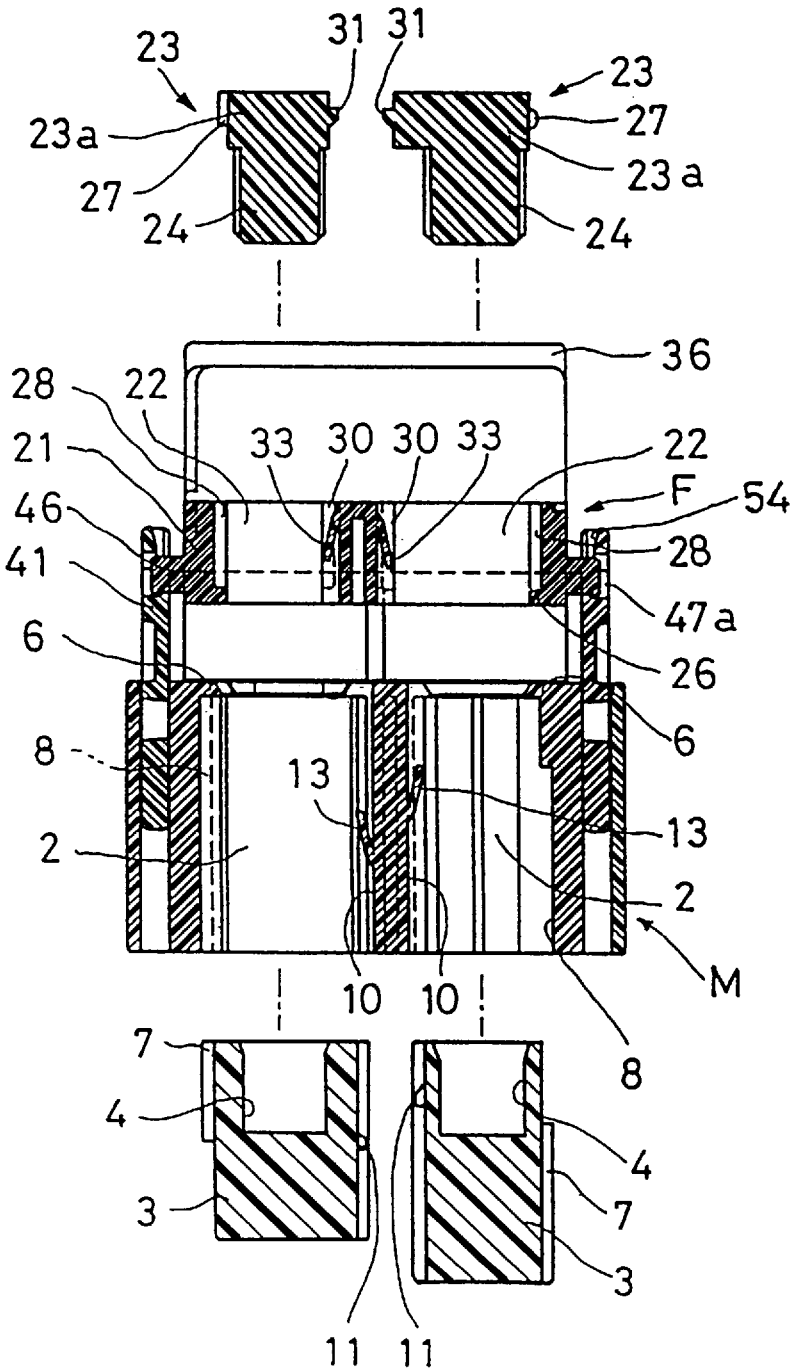
FIG. 3 is an exploded cross-section, taken along the line 3—3 in FIG. 2, of a temporarily assembled state.
Figure 6:
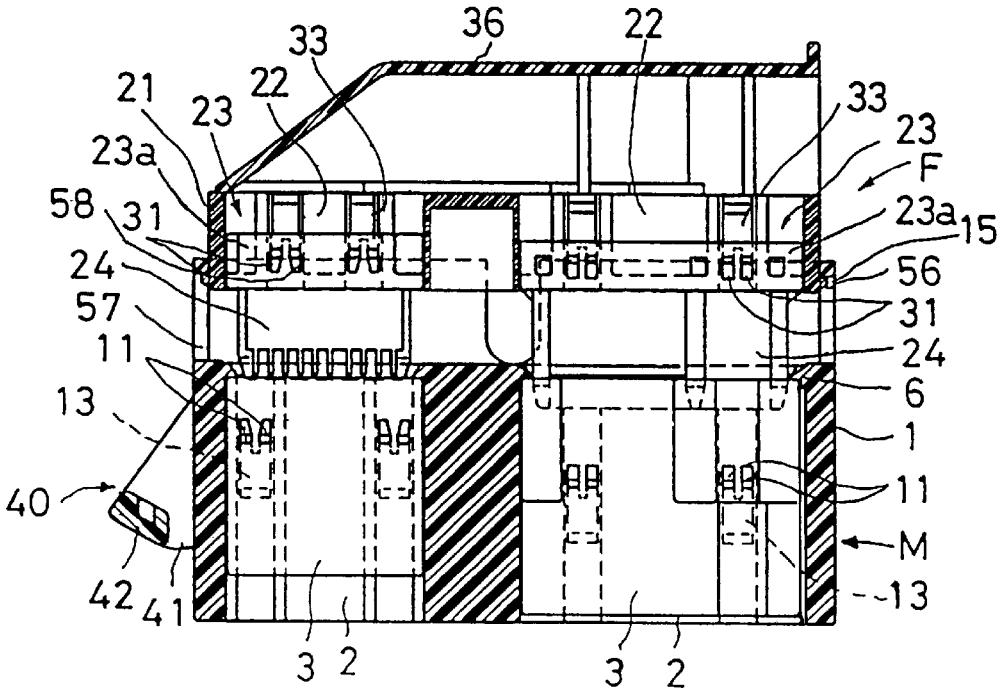
FIG. 6 is a longitudinal cross-section corresponding to FIG. 5.

As shown in FIG. 3 and FIG. 6, the male sub-connectors 3 have an approximately right-angled parallelepiped shape externally, are accommodated across approximately the whole of the depth of the insides of the above-mentioned apertures 2, and are provided with a predetermined clearance between their outside surfaces and the inside surfaces of the apertures 2. Furthermore, a recessed engagement portion 4, in which the engaging projection 24 of a companion female sub-connector 23 engages, is formed in the top surface of the male sub-connector 3. Cavities, which are not depicted, are formed in the male sub-connectors 3, and the usual metal male terminals are fitted in each cavity, projecting within the above-mentioned recessed engagement portions 4.

Abutment walls 6 projecting inwards are formed at the edges of the apertures. The male sub-connectors 3 are inserted from below (as illustrated) and projections 7 provided projecting on their sides follow guiding grooves 8 provided in the apertures. Insertion movement stops when the outer edges of the recessed engagement portions 4 abut against the abutment walls 6, this position being the fully inserted condition of a male sub-connector 3.

As shown in FIG. 2, longitudinal grooves 10 are provided in the side walls running from the bottom surface to the top surface on the opposite longer edges of the apertures 2, the grooves being at both ends, making a total of four apiece, as illustrated.

As shown in FIG. 6, latching projections 11 at predetermined heights on the male sub-connectors 3 corresponding to the above-mentioned longitudinal grooves 10. The top edges of the projections 11 have an angled front face, and lances 13 are provided projecting integrally from the bottoms of the longitudinal grooves 10. As shown in FIG. 3, each lance 13 is formed so that it faces upwardly and inwardly in its natural state, and is adapted to latch on the under surface of the corresponding projection 11 when the male sub-connector 3 has been completely inserted in the respective aperture 2. The lances 13 are able to deform and bend outwards under their own resilient force.

A guide wall 15 is provided projecting to a predetermined height on the male frame 1 around the entire perimeter thereof and constitutes a guide surface for the female frame 21.

The female-side split connector F is now described with reference to FIG. 1 and FIGS. 3 and 4. This split connector F has a female frame 21 approximately the same height as the guide wall 15 provided on the male frame 1, and has an external shape which engages very closely with the inside of this guide wall 15. A total of five through apertures 22 are formed in this female frame 21 corresponding to the apertures 2 in the male frame 1. Female sub-connectors 23 equipped with metal female terminals are accommodated individually inside the apertures 22. Moreover, as with the male-side split connector M already discussed, although the apertures 22 and the female sub-connectors 23 have different shapes, the basic shape and function are the same and therefore in this description the same reference has been given to all the apertures 22, female sub-connectors 23 and ancillary members for accommodating the female sub-connectors 23.

As shown in FIG. 3 and FIG. 6, these female sub-connectors 23 have, on their bottom surface side (as viewed), engagement projections 24 which engage inside the recessed engagement portions 4 of the male sub-connectors, and are provided with a predetermined clearance between the outside surface of the body portion 23*a* and the inside surface of the aperture 22. Cavities, which are not depicted, are formed in the female sub-connectors 23 to receive the usual metal female terminals. The female sub-connectors 23 are inserted into the accommodating holes 22 from above while projections 27 projecting from the side surfaces of the body portions 23*a* are guided by the guiding grooves 28, and insertion ceases when the projections 27 abut against abutment portions 26 provided on the bottom edges of the guiding grooves 28, this position being the fully inserted condition of the female sub-connector 23.

As shown in FIG. 6, the engagement projections 24 project from the underside of the female frame 21 when the female sub-connectors 23 have been completely inserted. The engagement projections 24 of the female sub-connectors 23 engage on the inside of the recessed engagement portions 4 of the male sub-connectors 3, whereupon the tabs of the metal male terminals enter the cavities of the female sub-connectors 23 and connect with the metal female terminals fitted therein.

Longitudinal grooves 30 are provided in the side walls running from the top surface to the bottom surface on the opposite longer edges of the apertures 22 at both ends, making a total of 4 apiece as illustrated. As shown in FIG. 6, latching projections 31 are provided in predetermined positions on the female sub-connectors 23 corresponding to the longitudinal grooves 30. The bottom ends of the projections 31 (as viewed) have an angled face, and lances 33 are provided projecting integrally from the bottoms of the longitudinal grooves 30. As shown in FIG. 3, these lances 33 face downwardly, are inclined inwardly in their natural state, and are adapted to engage the undersurface of a corresponding projection 31.

A cover 36 for covering and protecting electrical wires, which are not depicted but are led out from the female sub-connectors 23, is provided on the top surface of the female frame 21. This cover 36 is formed slanting down to the front (the left in FIG. 1) to avoid the lever 40 which is discussed hereinbelow, and is open to its rear to permit the wires to exit. The cover has resilient lock legs 37 formed at the bottom edges of both side surfaces which engage latching projections 38 provided on the side surfaces of the female frame 21.

A lever 40 is supported by means of a shaft 43 on the male frame 1 with freedom to swing. This lever 40 has two arms 4 which straddle the male frame 1, and are connected by a linking portion 42. Part of the outside surface of the arms 41 is covered by a cover plate 45 spaced from the side surfaces of the male frame 1. Roughly arc-shaped cam grooves 47 which engage with follower pins 46 projecting from the side surfaces of the female frame 21 are formed in the arms 41.

Figure 5:
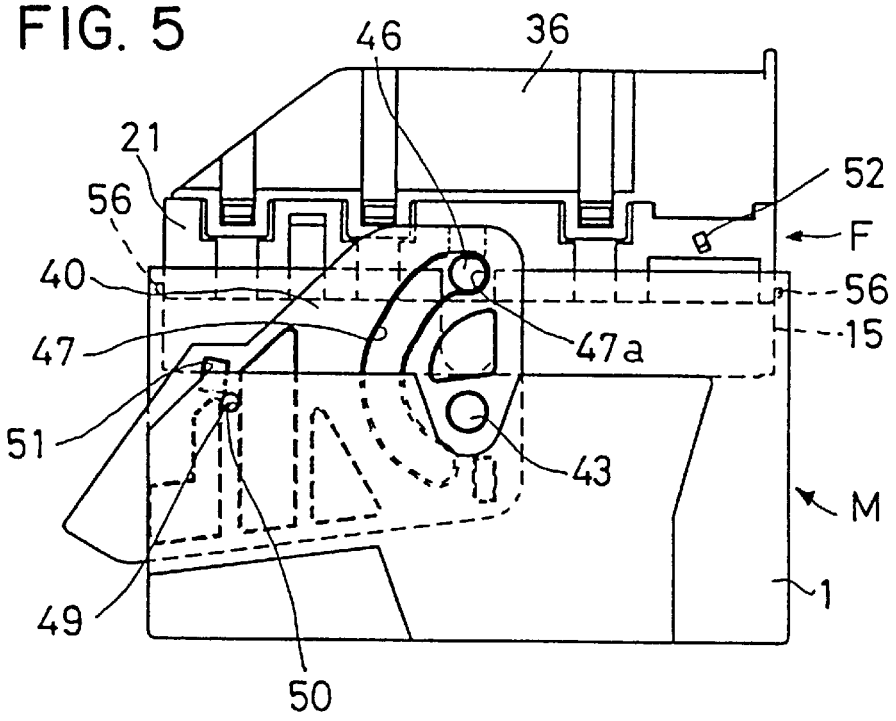
FIG. 5 is a front elevation of the temporarily assembled state of the split connector.
Figure 7:
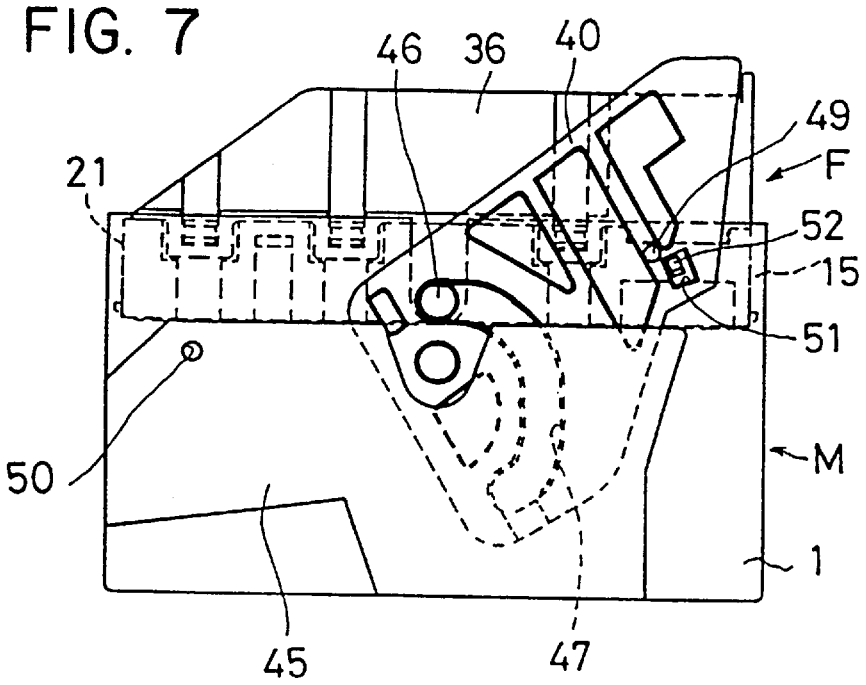
FIG. 7 is a front elevation of the fully assembled state of the split connector.

When the cam groove 47 and the follower pin 46 are engaged, the lever 40 can be pivoted from the "open position" shown in FIG. 5 to the "coupled position" shown in FIG. 7, and the accompanying lever action has the consequence of drawing the female frame 21 to the male frame 1. It will be noted that the lever 40 is held in the "open position" by a pin 49, which projects from the lever 40, and fits into a latching hole 50 in the cover plate 45. The lever 40 is held in the "coupled position" by a latching hole 51, which is at the side of pin 49, and fits over a lock projection 52 projecting from the female frame 21.

When the lever 40 is in the "open position" (as shown in FIG. 1), the leading end 47*a* of the cam groove 47 is above the male frame 1, and the inside of the portion above this leading end 47*a* is cut away to form an entry channel 54 into which the follower pin 46 of the female frame 21 can engage.

As the follower pin 46 of the female frame 21 passes through the entry channel 54 and engages with the leading end 47*a* of the cam groove 47, the lower edge of the female frame 21 fits into the guide wall portion 15 to a predetermined extent.

Figure 4:
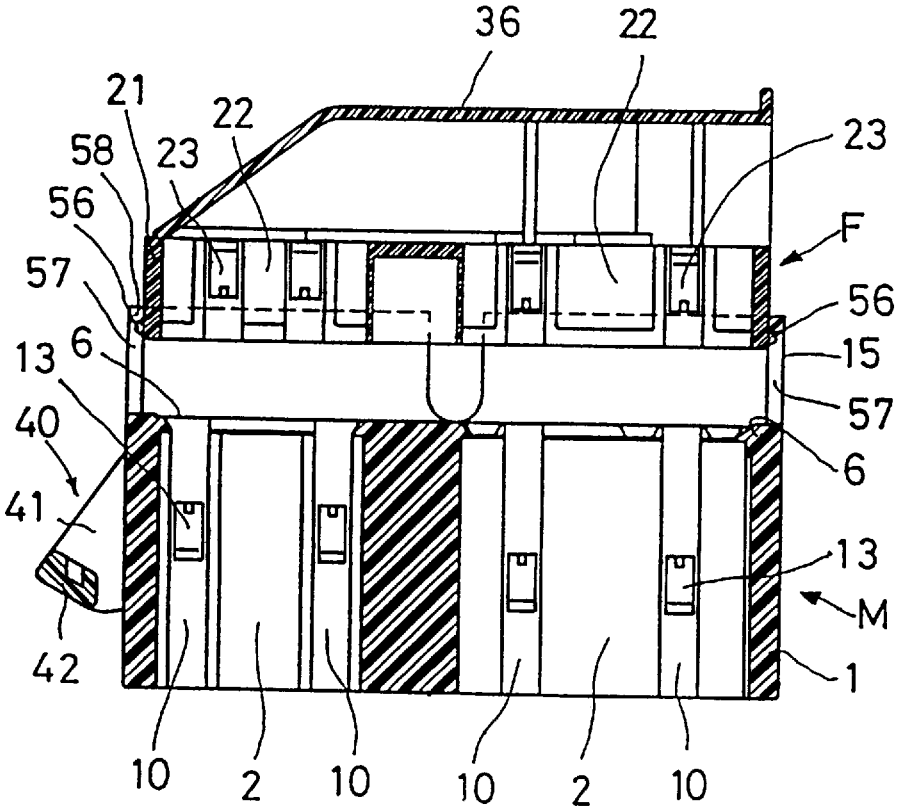
FIG. 4 is a cross-section, taken along the line 4—4 in FIG. 2, of the temporarily assembled state in which the sub-connectors have been removed.

As shown in FIG. 4, hooks 56 projecting outwards are formed in the central regions of the lower edges of both the front and the rear surfaces of the female frame 21. Longitudinal grooves 57, which engage with the above-mentioned hooks and permit them to move vertically, are cut in the central portions of both the front and the back surfaces of the guide wall portions 15 of the male frame 1 from a position a little below the upper edge to the lower edge. The upper edge of the longitudinal grooves 57 constitute latching portions 58 for the hooks 56.

The procedure with which the connector is put together is now described.

First, the male sub-connectors 3 are inserted into the respective apertures 2 of the male frame 1. The four latching projections 11 respectively engage with the lances 13 near the end of the insertion, and these lances 13 are deformed and subsequently spring back to engage the undersides of the projections 11. When the male sub-connector 3 abuts against the abutment wall 6. The male sub-connectors 3 are thus retained against removal.

The female sub-connectors 23 are respectively inserted in the respective apertures 22 of the female frame 21. In similar fashion, the latching projections 31 are engaged by the lances 33 to retain the sub-connectors against removal. The electrical wires led out from the female sub-connectors 23 are consolidated and run in a single direction, and the cover 36 is attached.

Subsequently, the lever 40 is placed in the "open position" as shown in FIG. 1, and the male frame 1 and female frame 21 are brought together. The follower pin engages with the leading end 47*a* of the cam groove 47, after passing through the entry channel 54. As shown in FIGS. 5 and 6, at this time the lower edge of the female frame 21 is fitted into the guide wall 15 of the male frame 1, and the hooks 56 to the front and back of the female frame 21 resiliently engage the longitudinal grooves 57 of the guide wall 15. The female frame 21 is thereby temporarily assembled on the male frame 1. At this point the lower edges of the projections 24 are either directly above the recessed engagement portions 4, or are slightly engaged therewith.

Subsequently, the lever 40 is pivoted from the "open position" to the "coupled position" whilst the holding pin 49 is separated from the latching hole 50. Because the female frame 21 is temporarily assembled on the male frame 1, there is no longer any need to hold the female frame 21 by hand, and the lever 40 is swung by taking the connecting portion 42 in the hand and pulling upwards.

Figure 8:
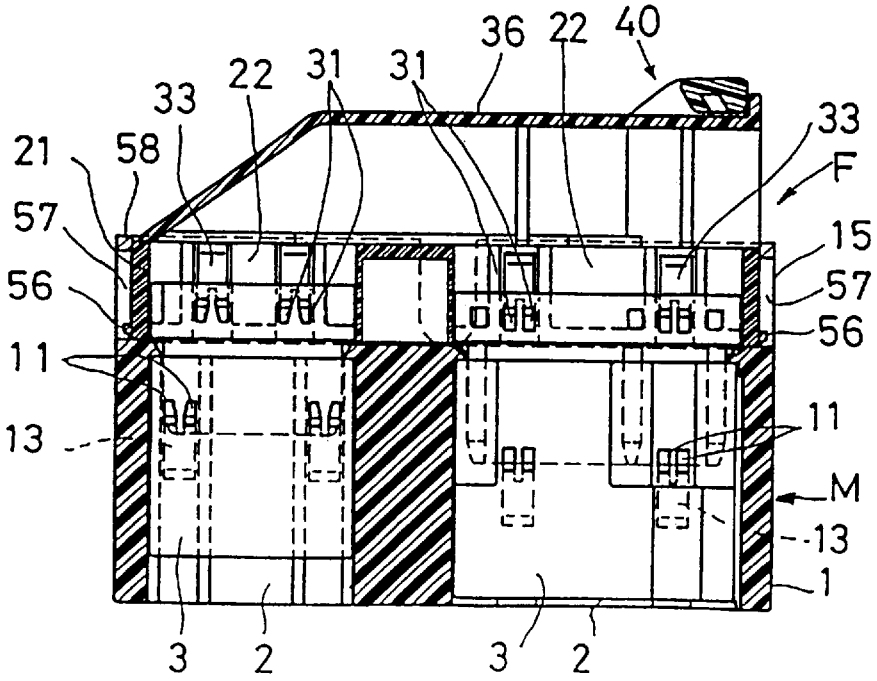
FIG. 8 is a longitudinal cross-section corresponding to FIG. 7.

As the lever 40 is swung to the "coupled position", the follower pin 46 is pushed downwards (FIG. 5) by the cam groove 47 and, as shown in FIGS. 7 and 8, the female frame 21 is drawn to the male frame 1 inside the guide wall 15 while the hooks 56 move downwards along the longitudinal grooves 57. A lateral load acts on the female frame 21 in the direction at right angles to the direction of approach to the male frame 1, as a result of the shape of the cam groove 47, but the female frame 21 is drawn directly towards the male frame 1 guided along the inner surface of the guide wall 15.

Consequently, the engagement projection 24 of the female sub-connector 23 is directly engaged, without bending or stressing inside the recessed engagement portions 4 of the corresponding male sub-connectors 3. Even if there is misplacement within tolerance limits between the corresponding male and female sub-connectors 3 and 23, such errors are absorbed by the clearance and the male sub-connector 3 and female sub-connector 23 are directly engaged. This results in the male and female metal terminals being properly connected with each other.

Furthermore, the male sub-connector 3 and female sub-connector 23 are latched by the lances 13 or 33 at the four corners thereof, and there is no risk that they will tilt in the respective apertures 2 and 22, and therefore the stressed engagement of corresponding male and female sub-connectors 3 and 23 with each other is all the more reliably prevented. It should be noted that the lever 40 which has swung to the "coupled position" is held in this position by engagement of the latching hole 51 on the lock projection 52.

A second embodiment of the present invention is described below with reference to FIGS. 9 to 16.

Figure 9:
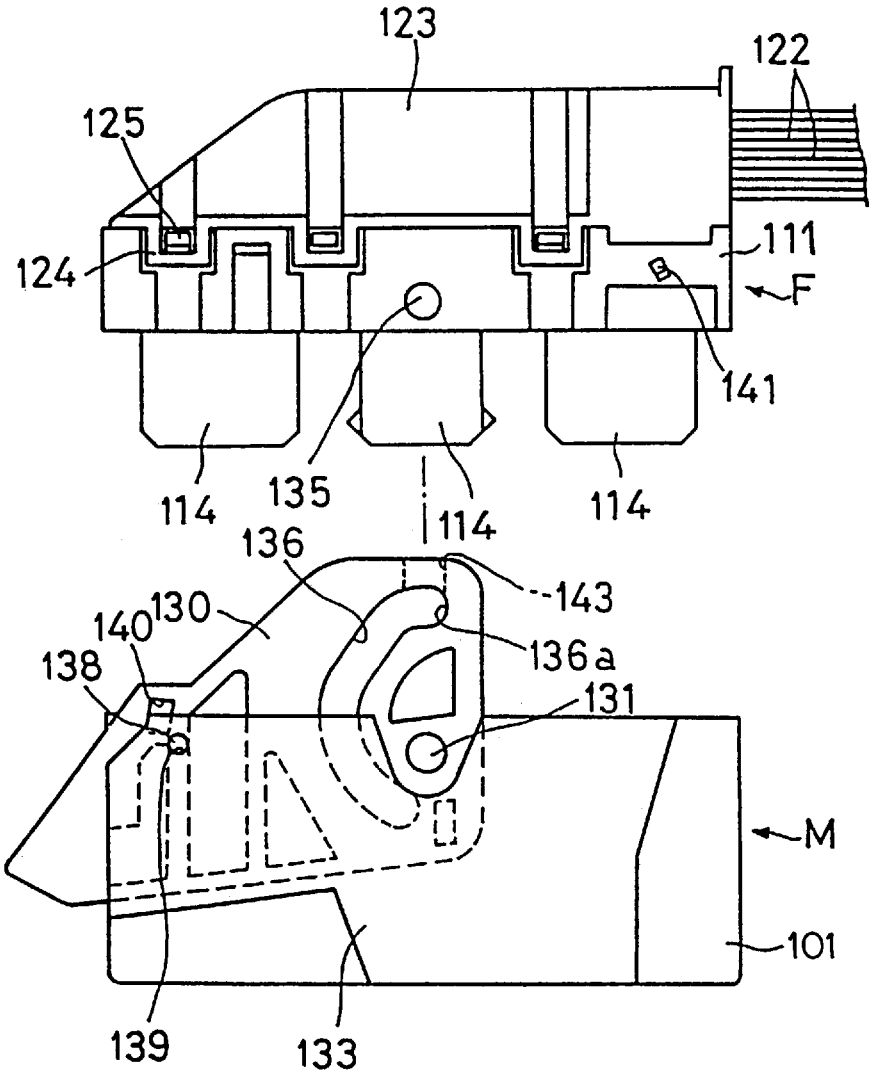
FIG. 9 is a side elevation of a split connector according to another embodiment of the present invention prior to assembly.

As shown in FIG. 9, the second embodiment has a male-side split connector M and a female-side split connector F which are to be coupled to each other.

Figure 12:
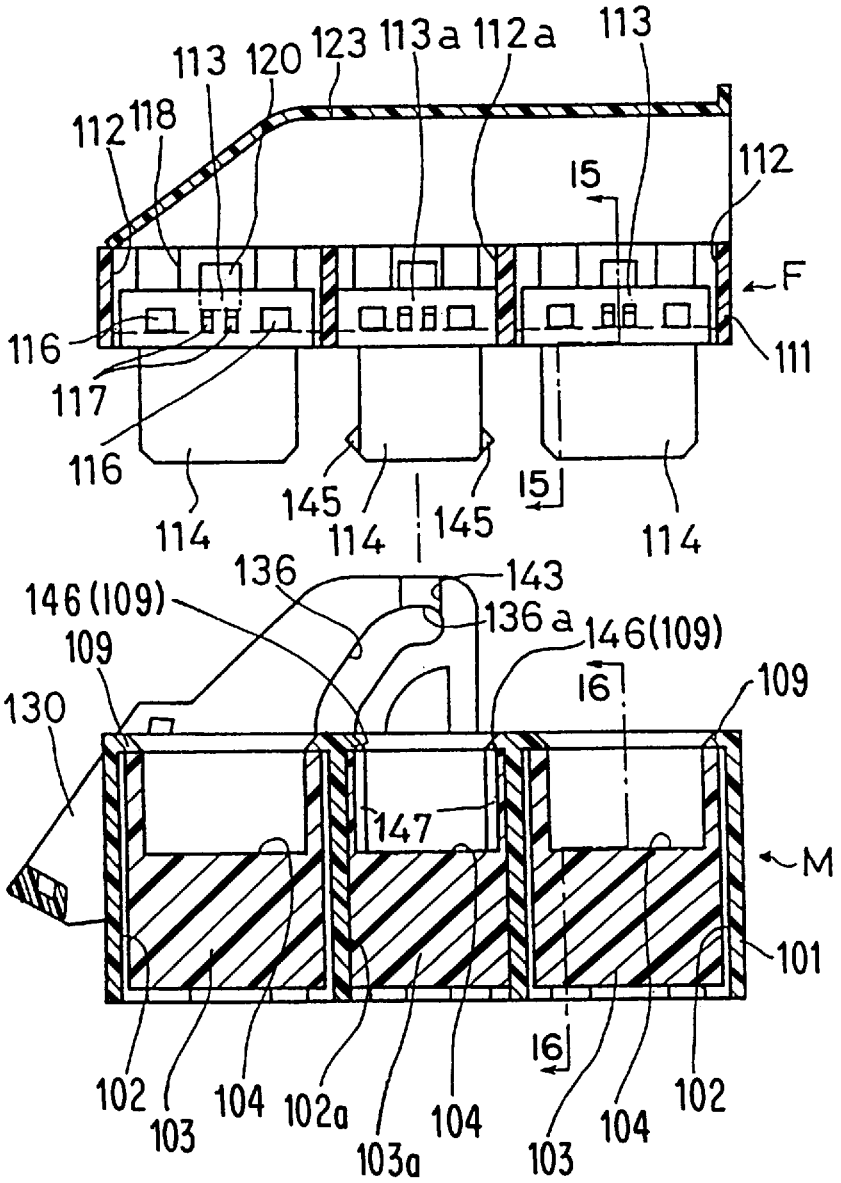
FIG. 12 is a vertical cross-section through the connector of FIG. 9 in a state prior to assembly.
Figure 16:
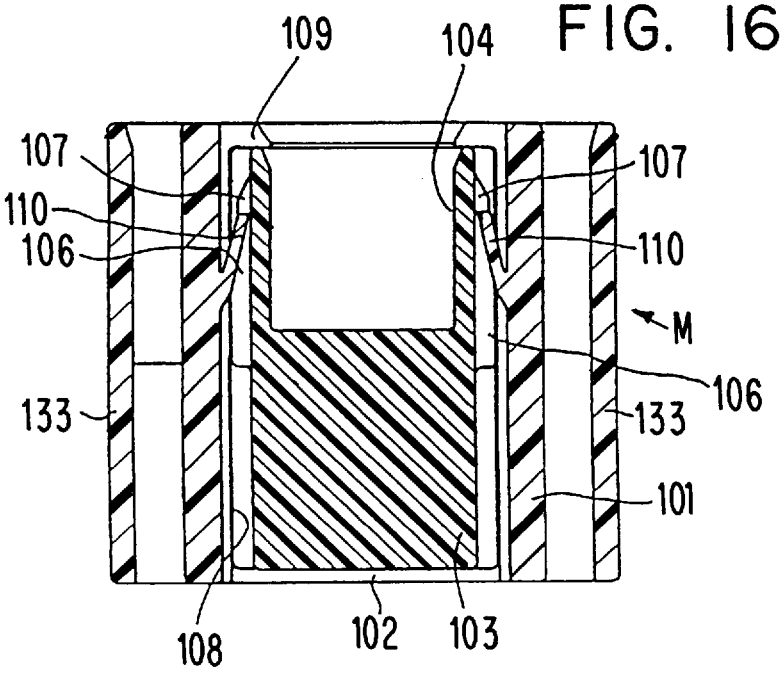
FIG. 16 is an enlarged cross-section along the line 16—16 in FIG. 12.

The male-side split connector is described mainly with reference to FIGS. 9, 12 and 16. This split connector M has a male frame 101 which forms an approximate right-angled parallelepiped externally, and has a row of three through apertures 102, forming approximate rectangles in plan. Male sub-connectors 103 equipped with male metal terminals are accommodated individually in each aperture 102.

The male sub-connectors 103 are substantially as described in the first embodiment and are accommodated in the apertures 102; they have a recessed engagement portion 104 in which the engaging projection 114 of a companion female sub-connector engages.

As shown in FIG. 16, two linear projections 106 are formed at the upper ends of the male sub-connectors 103, on the sides to left and right, between which two abutments 107 are formed. The male sub-connector 103 is inserted from below (as viewed) with its linear projections 106 running along longitudinal grooves 8 formed on the inside surface of the aperture 102, the insertion coming to a halt when the circumferential edge of the recessed engagement portion 104 abuts against the abutment wall 109. Lances 110 resiliently latch the abutments 107.

The female-side split connector F is described with reference to FIGS. 9, 12 and 15. The split connector F has a relatively thin female frame 11 having three through apertures 112 corresponding to the apertures 102 of the male frame 101. Female sub-connectors 113 are accommodated individually inside the apertures 112.

Figure 15:
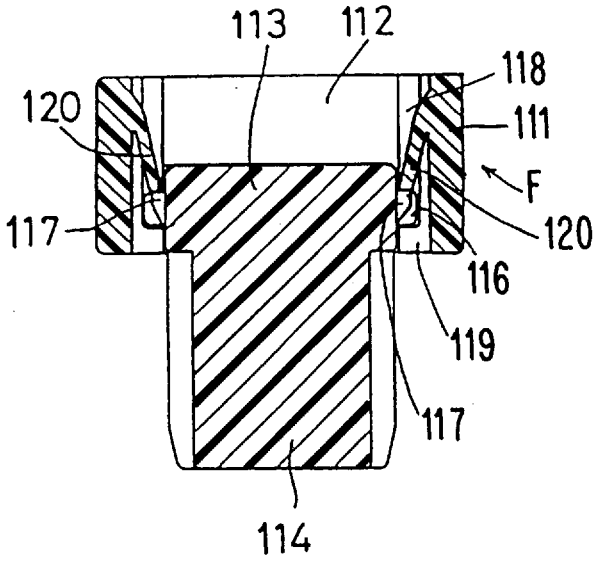
FIG. 15 is an enlarged cross-section along the line 15—15 in FIG. 12.

As shown in FIGS. 12 and 15, these female sub-connectors 113 have engagement projections 114 which engage inside the recessed engagement portions 104.

As also shown in FIGS. 12 and 15, two projections 116 are formed on both the left and right side surfaces of the female sub-connectors 13, for engagement in and with lances 20. The female sub-connectors 113 are thereby latched with their engagement projections 114 projecting from the under surface (as viewed).

A cover 123 for covering and protecting electrical wires 122 led out from the female sub-connectors 113, is provided on the top surface of the female frame 111. This cover 123 slopes down at the front (the left in FIG. 9) to avoid the lever 130 which is discussed hereinbelow, and is open to its rear to allow the wires to exit. Resilient lock legs 124 formed at the bottom edges of both side surfaces engage latching projections 125 projecting from the side surfaces of the female frame 111.

A lever 130 is supported with freedom to pivot on the male frame 101 by means of a shaft 131. This lever 30 has two-leg shape straddling the male frame 101, and part of the outside surface is enclosed by a cover plate 133 spaced from the side surfaces of the male frame 101. The lever is similar to the lever 40 described with reference to the first embodiment, and has cam grooves 136, follower pins 135, a pin 138, a latching hole 139, a latching hole 140, a projection 141 and an entry channel 143 for the follower pin 135.

As shown in FIG. 12, the middle male sub-connector constitutes a positioning connector 103*a*, which has a shape such that its outside surfaces to front and rear (left and right in the figure) are engaged tightly between the inside surfaces to front and rear in the respective aperture 102*a* without leaving any clearance. As regards the two male sub-connectors 103 at either end, a predetermined clearance is left between the apertures 102 in the front and rear direction.

The centre female sub-connector also constitutes a positioning connector 113*a*, and this has a shape such that its outside surfaces to front and rear are engaged tightly between the corresponding inside surfaces in the centre aperture 112*a*, without leaving any clearance. As regards the two female sub-connectors 113 at either end, a predetermined clearance is left between the apertures 112 in the front and rear direction.

A pair of lock projections 145 (FIG. 12) are provided in the centre of the two surfaces to front and rear of the engagement projection 114 at the lower edge thereof. Abutment walls 109 to front and rear of the aperture 102*a* double as latching portions 146 which latch on to the above-mentioned lock projections 145. Longitudinally oriented escape grooves 147, into which said lock projections 145 fit and which allow relative vertical movement are provided in the side surfaces to front and rear of the recessed engagement portion 104 of the positioning connector 103*a*.

The assembly procedure for this embodiment is now described.

Firstly, the male sub-connectors 103 inserted in the corresponding apertures 102 of the male frame. The positioning connector 103*a* in the centre is held tightly so that it can move neither to the front or to the rear. In a similar fashion, the female sub-connectors 113 are inserted in the aperture 112 of the female frame 111 with the engagement projections 114 projecting from the under surface. The positioning connector 113*a* is similarly held against movement to the front or to the rear. Electrical wires 22 led out from the female sub-connectors 13 are consolidated and run in a single direction, and the cover 23, is attached.

Figure 13:
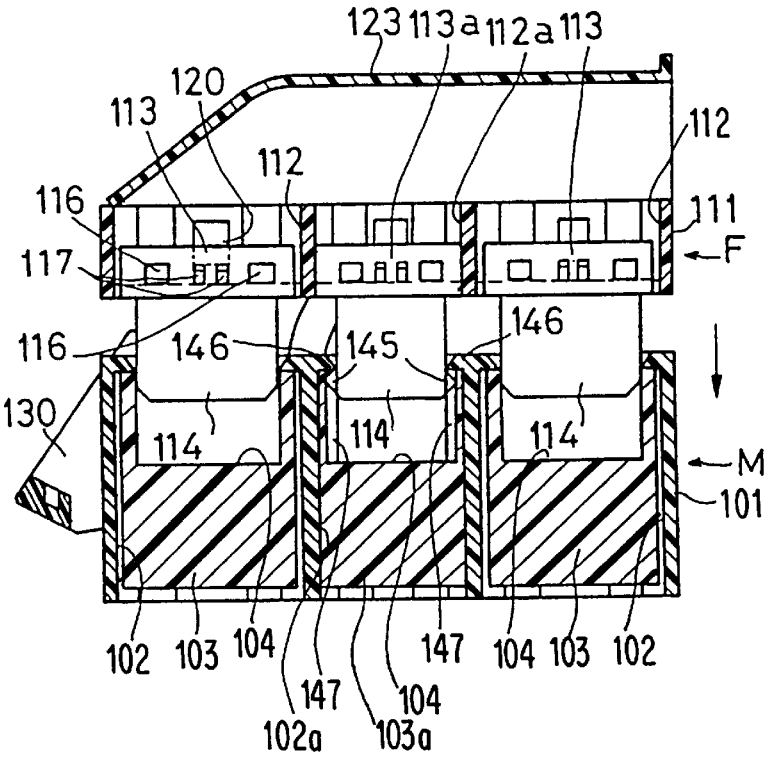
FIG. 13 corresponds to FIG. 12 and is a vertical cross-section of the temporarily assembled state.

The lever 130 is held in the "open position" as shown in FIG. 1, and the male frame 101 and the female frame 111 are pushed together. When this is done, as shown in FIG. 13 the engagement projection 114 fits into the aperture 102*a* with the lock projections 145 riding over the latching portions 146 at the top edges of the aperture 102*a*. The lock projections 145 pass beyond the latching portions 146 into the escape grooves 147 to give a temporarily assembled state.

Figure 10:
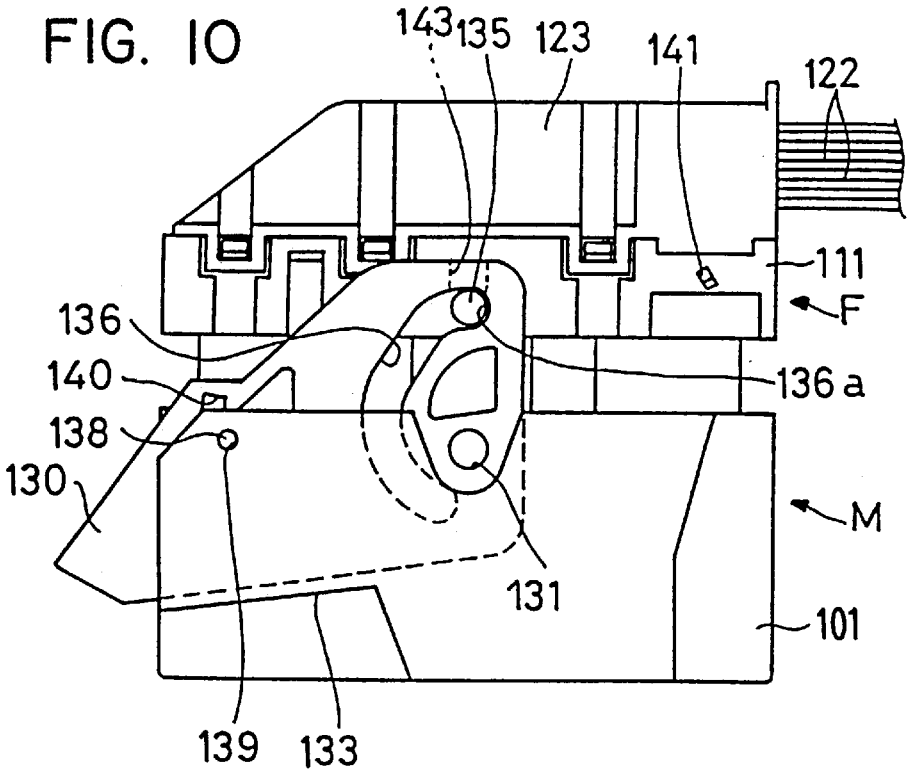
FIG. 10 is a side elevation of the split connector of FIG. 9 in the temporarily assembled state.

At this time, the engagement projections 114 of the two female sub-connectors 113 at either end are engaged inside the corresponding male sub-connectors 103, and if there is mispositioning within tolerance, they will engage by virtue of the clearance. Furthermore, as shown in FIG. 10, in this temporarily assembled state the follower pin 135 is engaged with the leading end 136*a* of the cam groove 136 having passed along entry channel 143 as the lever 130 is resiliently sprung.

Subsequently, the lever 30 is pivoted from the "open position" to the "coupled position", the holding pin 138 being separated from the latching hole 139. Because the female frame 111 is temporarily assembled on the male frame 101, there is no longer any need to hold the female frame by hand, and the lever can be pivoted by taking the front edge in the hand and pulling upwards.

Figure 11:
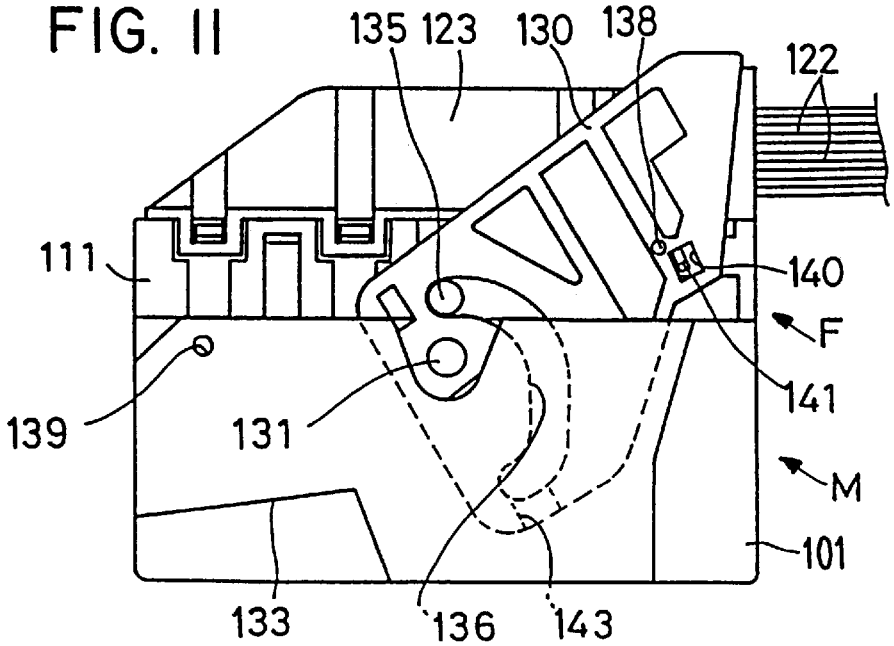
FIG. 11 is a side elevation of the split connector of FIG. 9 in the fully assembled state.
Figure 14:
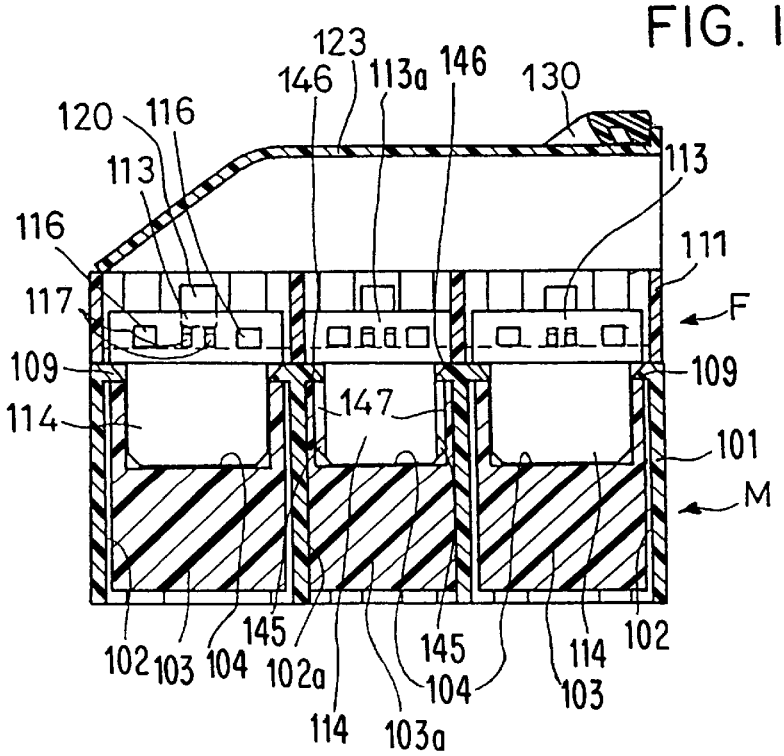
FIG. 14 corresponds to FIG. 12 and is a vertical cross-section of the fully assembled state.

As the lever 130 is pivoted to the "coupled position", the follower pin 135 is pushed downwards by the cam groove 136 as shown in FIGS. 11 and 14. The lateral load acting on the female frame, as a result of the cam groove 36, is resisted by the projections 145 which slide in the grooves 147. Consequently, the engagement projections 114 of all the female sub-connectors 113 are directly engaged, without tilting or stress, with the corresponding male sub-connectors 103. It should be noted that the lever 130 which is held in the coupled position by engagement of the latching hole 140 and projection 141.

The present invention is not limited to the above description or to the embodiment described with reference to the figures, and the following embodiments are also included in the technical scope of the present invention, and various modifications other than those which follow can also be implemented without departing from the scope of the invention.

In the first embodiment described above the guide wall portion 15 is provided on the male frame 1, but it may conversely be provided on the female frame 21.

Furthermore, this embodiment is not limited to a lever format, and it can also be applied in similar fashion to a split connector of a type fastened with a bolt, the guide wall ensuring that the projections 24, recessed portions 4 and metal terminals are substantially relieved of the guiding function and forces associated therewith.

In the second embodiment described above the central sub-connectors were used as the positioning connectors, but either of the sets on either end can also be used as the positioning connectors. Furthermore, the invention can also be applied in similar fashion to units with two or with four or more sets of corresponding sub-connectors and with one of these sets used as the positioning sub-connectors. The latching portion for latching on to the lock projections 145 may alternatively be provided on the male side sub-connector itself. Furthermore, depending on the shape of the male and female sub-connectors and on the way in which they are accommodated in the frames, a lock projection may be provided on the male side connector, and a latching portion provided on the female frame. Finally the second embodiment is not limited to a lever format, and it can also be applied in similar fashion to a split connector of a type fastened with a bolt.

We claim:

1. An electrical connector assembly comprising first and second connectors, each of said connectors comprising a frame having a plurality of through apertures, and each of said apertures being adapted to receive and retain one of a plurality of male and female sub-connectors each having a plurality of electrical terminals, the sub-connectors being arranged in aligned pairs with one sub-connector of a pair being accommodated in a respective aperture with clearance, each said sub-connector having a substantially rectangular parallelepiped configuration, and each said frame having a plurality of resilient latching members in each of said through apertures to engage locking edges of the respective sub-connectors along distal corners of the sub-connectors and thereby retain said sub-connectors within the respective frames, and a lever on one of said frames engaging the other frame and operating to draw the frames toward each other so as to interconnect said paired sub-connectors, said connectors each further including frame guide surfaces on the frames which interengage each other prior to engagement of the paired sub-connectors and guide said frames toward one another upon operation of said lever to bring the paired sub-connectors into mutual engagement such that said terminals are relieved of guiding forces during their interconnection.

2. An assembly according to claim 1 wherein said connectors have substantially planar meeting faces, said frame guide surfaces guiding said connectors in a direction perpendicular to said meeting faces.

3. An assembly according to claim 1 wherein said frame guide surfaces comprise an upstanding wall of one of said frames, the other of said frames having an abutment for engagement with said wall.

4. An assembly according to claim 3 wherein said wall extends around the periphery of the respective frame and is continuous.

5. An assembly according to claim 4 wherein said abutment engages the inner side of said peripheral wall.

6. An assembly according to claim 1 wherein one pair of sub-connectors is fixed against lateral movement with respect to a respective frame, and said frame guide surfaces are provided by said one pair.

7. An assembly according to claim 6 wherein the frame guide surfaces comprise an exterior surface of one sub-connector and an interior surface of the other sub-connector of said one pair.

8. An assembly according to claim 6 or claim 7 wherein said one pair of sub-connectors have respective opposite planar sides comprising said frame guide surfaces.

9. An assembly according to claim 1 and further including a latch to releasably engage said frame guide surfaces at separation greater than the minimum separation of said terminals.

10. An assembly according to claim 9 wherein said latch comprises opposite recesses of one of said connectors and opposite projections of the other of said connectors, said recesses and projections being resiliently engageable.

11. An assembly according to claim 1 wherein said sub-connectors include proximal abutments for engagement with a respective frame on insertion therein.

12. An assembly according to claim 11 wherein said resilient latching members engage the distal edges of the respective sub-connectors.

13. An assembly according to claim 1 wherein both male and female subconnectors of a pair are accommodated in a respective frame with clearance.

* * * * *